US009070971B2

(12) United States Patent
Johnston

(10) Patent No.: US 9,070,971 B2
(45) Date of Patent: Jun. 30, 2015

(54) DUAL CIRCULARLY POLARIZED ANTENNA

(76) Inventor: Ronald H. Johnston, Calgary (CA)

( * ) Notice: Subject to any disclaimer, the term of this patent is extended or adjusted under 35 U.S.C. 154(b) by 975 days.

(21) Appl. No.: 13/107,016

(22) Filed: May 13, 2011

(65) Prior Publication Data

US 2011/0279339 A1 Nov. 17, 2011

Related U.S. Application Data

(60) Provisional application No. 61/344,444, filed on May 13, 2010.

(51) Int. Cl.

| | |
|---|---|
| ***H01Q 13/00*** | (2006.01) |
| ***H01Q 9/16*** | (2006.01) |
| ***H01Q 13/02*** | (2006.01) |
| ***H01Q 19/10*** | (2006.01) |
| ***H01Q 21/26*** | (2006.01) |

(52) U.S. Cl.

CPC ..... *H01Q 9/16* (2013.01); *H01Q 13/02* (2013.01); *H01Q 19/10* (2013.01); *H01Q 21/26* (2013.01)

(58) Field of Classification Search

USPC ..... 343/786, 772, 850, 858

See application file for complete search history.

(56) References Cited

U.S. PATENT DOCUMENTS

| | | | | |
|---|---|---|---|---|
| 3,740,754 | A | 6/1973 | Epis | 343/797 |
| 3,789,416 | A | 1/1974 | Kuecken et al. | 343/792 |
| 4,062,019 | A | 12/1977 | Woodward et al. | 343/797 |
| 4,109,254 | A | 8/1978 | Woloszczuk | 343/797 |
| 4,686,536 | A | 8/1987 | Allcock | 343/700 MS |
| 5,543,810 | A | 8/1996 | Park | 343/771 |
| 5,966,102 | A | 10/1999 | Runyon | 343/820 |
| 6,072,439 | A | 6/2000 | Ippolito et al. | 343/797 |
| 6,208,291 | B1 | 3/2001 | Krasner | 342/357.12 |
| 6,320,552 | B1 | 11/2001 | Volman et al. | 343/772 |
| 6,501,416 | B1 | 12/2002 | Backhouse et al. | 342/42 |
| 6,975,278 | B2 | 12/2005 | Song et al. | 343/795 |
| 2009/0204372 | A1 | 8/2009 | Johnston et al. | 702/191 |

FOREIGN PATENT DOCUMENTS

| | | |
|---|---|---|
| CA | 2640651 | 6/2000 |
| CA | 2621886 | 8/2008 |
| DE | 10 2005 002964 | 8/2005 |
| JP | 59-23602 | 2/1984 |

(Continued)

OTHER PUBLICATIONS

"Behavior of Systems Involving Resonant Primary and Secondary Circuits," in *Electronic and Radio Engineering*, T.E. Terman, McGraw-Hill Inc., Fourth Edition, 63-72, Sec. 3.5, 1955.

(Continued)

*Primary Examiner* — Ahshik Kim

(74) *Attorney, Agent, or Firm* — Gordon Intellectual Property Law PLLC

(57) ABSTRACT

A dual circularly polarized antenna is described. In some embodiments, the antenna includes a waveguide having an aperture at a first end and a conducting component at a second end, the conducting component shorting the waveguide. A first driven dipole is substantially orthogonal to a second driven dipole, and both the first and second driven dipoles are located near the aperture of the waveguide. The first and second driven dipoles are connected to the conducting component by one or more plates and configured to be fed in quadrature. A resonator is positioned near the first and second driven dipoles.

17 Claims, 23 Drawing Sheets

(56) References Cited

FOREIGN PATENT DOCUMENTS

| | | |
|---|---|---|
| JP | 60-90111 | 3/1994 |
| WO | WO 98/59257 | 12/1998 |
| WO | WO 2006/049963 | 5/2006 |
| WO | WO 2009/067805 | 6/2009 |

OTHER PUBLICATIONS

Carver, Myths and realities of anywhere GPS: high sensitivity versus assisted techniques, *GPS World*, pp. 30-41, Sep. 2005.
Gao et al., "Antennas for modern small satellites," *IEEE Antennas and Propagation Magazine*, 51( 4):40-56, 2009.
International Search Report and Written Opinion, issued in PCT/CA2008/002086, date of mailing Apr. 6, 2009.
International Search Report and Written Opinion issued in PCT/IB2011/001431 dated Oct. 12, 2011.
Ledvina et al., "Bit-wise parallel algorithms for efficient software correlation applied to a GPS software receiver," Wireless Communications, IEEE Transactions, 3:1469-1473, Sep. 2004.
Mehrnia et al., "An all digital spread spectrum processor featuring multiplier free-zero-IF down-conversion, decimation, and multiplexed dispreading," Microelectronics, ICM 2000, Proceeding of the 12th International Conference, pp. 363-366, Oct. 21-Nov. 2, 2000.
Rao et al., "A High Performance Circularly Polarized Feed Array for Satellite Communication Antennas," *IEEE APS Int.*, 3:1420-1423, 1989.
Scire-Scappuzzo and Makarov, "A Low-Multipath Wideband Gps Antenna with Cutoff or Non-Cutoff Corrugated Ground Plane," *IEEE Trans. A&P*, 57(1): 33-46, 2009.
Sichak and Milazzo, "Antennas for Circular Polarization" *Proc. IRE*, 36(8): 997-1001, 1948.
Tranquilla and Colpitts, "Development of a class of antenna for spacebased Naystar GPS applications," *6th Int. Conf. Ant. & Prop., ICAP* 89, 1:65-69, 1989.
van Diggelen, "Global locate indoor GPS chipset & services," presented at ION-GPS, Salt Lake City, USA, pp. 1-7, 2001.
Ward et al. "Chapter 5: Satellite Signal Acquisition, Tracking, and Data Demodulation," in *Understanding GPS principles and applications*, Artech House, Incorporated, pp. 153-241, Feb. 1996.
Wilkinson et al., "Two Communication Antennas for the Viking Lander Spacecraft," *IEEE APS Int. Sym.*, 12:214-216, 1974.
Winternitz et al., "Navigator GPS receiver for fast acquisition and weak signal space applications," presented at the ION GNSS Meeting, Long Beach, CA, pp. 1-14, Sep. 21-24, 2004.

$$I_\Phi = |I_Z| \angle I_Z + 90°$$

DUAL CIRCULARLY POLARIZED ANTENNA

RELATED APPLICATION

This application claims priority to U.S. Provisional Application Ser. No. 61/334,444 filed May 13, 2010, the entire text of which is specifically incorporated herein by reference without disclaimer.

BACKGROUND OF THE INVENTION

1. Field of the Invention

Embodiments of the invention relate generally to the field of antenna systems and more specifically to receiving antennas for satellite-based positioning systems.

2. Description of the Related Art

Conventional satellite-based positioning systems, for example, a Global Navigation Satellite System (GNSS) such as the Global Positioning System (GPS) include a GPS receiver system. An important part of the receiving system is the antenna. GNSS satellites typically broadcast at two frequencies, 1.575 GHz, which is referred to as the L1 signal, and 1.225 GHz, which is referred to as the L2 signal. Therefore GNSS antennas may have to be capable of receiving signals at both frequencies.

Non-ideal behavior of the antenna presents limitations in determining position with very high accuracy. Optimally, the antenna would receive only direct signals from the satellite with very high electrical phase stability, regardless of the elevation and azimuth angles of the satellite. The antenna should have a means for rejecting signals that have become corrupted by reflection, diffraction and/or refraction from physical structures in the vicinity of the path (or paths) of the signals arriving at the receiving antenna. The satellites transmit towards the earth with Right Hand Circular Polarization (RHCP). The best simple receiving antenna, used by a conventional GPS receiving system, will be responsive only to RHCP signals. The response of the antenna to Left Hand Circular Polarization (LHCP) should be many decibels down from that of the RHCP over a wide angular range. This type of antenna will be referred to as a High Purity Circularly Polarized (HPCP) antenna. A good high RHCP over LHCP response corresponds to a low axial ratio, which is the magnitude of the RHCP plus the magnitude of the LHCP all divided by the magnitude of the RHCP minus the magnitude of the LHCP for a given angular position in space when the antenna is exposed to a pure Linearly Polarized EM wave. An RHCP antenna should have a high ratio of RHCP over LHCP, which corresponds to a low axial ratio. A 20 dB RHCP to LHCP ratio corresponds to an axial ratio of 1.75 dB and a 24.8 dB RHCP to LHCP ratio corresponds to an axial ratio of 1.00 dB.

Many types of circularly polarized (CP) antennas are available for consideration. Some of the widely used CP antenna types include the CP microstrip patch, helical, spiral slot radiator, crossed electric dipoles (or turnstile), crossed slots, conical spiral antennas among others. The various antennas discussed above all have various shortcomings for achieving the desired high performance GPS antenna with two outputs, RHCP and LHCP. Microstrip patch antennas are likely to be too narrow band. Helical and spiral antennas can be built for RHCP or LHCP but not for both outputs simultaneously. The turnstile antenna can be built to deal with both of the above problems but it has a very poor axial ratio in the plane of the dipoles. In fact, it is difficult to obtain a good axial ratio over a wide angular range (over the upper hemisphere) with virtually any circularly polarized antenna.

In high accuracy applications the mathematical processes utilized in the GPS receiver and subsequent digital processors determine the number of wavelengths and the number of electrical degrees between that satellite and the GPS receiving antenna phase center. It is therefore important that the GPS antenna have a phase center that stays in the same location within very small tolerances as the reception angle of a given incoming wave changes from near the horizon to the zenith. The phase center should also be independent of azimuth reception angle and be fairly independent of the frequency in use.

The use of crossed dipoles for generation of circular polarization is well known. The dipoles have a common center point, lie in one plane at right angles to each other and are fed by signals that are 90 degrees out of phase. This structure with feed lines and mounted above a ground plane, without the circular waveguide, has been called the "turnstile antenna." See Sichak, W. and S. Milazzo, "Antennas for Circular Polarization" Proc. IRE, Vol. 36, No. 8, August 1948, pp. 997-1001; Wilkinson, W., O. Woodward and W. Mulqueen, "Two Communication Antennas for the Viking Lander Spacecraft", IEEE APS Int. Sym., June 1974, Vol. 12, pp. 214-216; and U.S. Pat. No. 4,062,019 to Woodward et al. The placement of the turnstile antenna inside or near a circular waveguide cavity has been carried out. See U.S. Pat. No. 3,740,754 to Epis, U.S. Pat. No. 3,789,416 to Kuecken, and U.S. Pat. No. 4,109,256 to Woloszczuk. These authors have referred to the circular waveguide, with the top end open and the bottom end shorted out, as a "cup" and as a "cavity." More recently reports have appeared showing the use of a cup with interior patch antennas. See Gao, S. et al., "Antennas for modern small satellites," IEEE Antennas and Propagation Magazine, Vol. 51, No. 4, pp. 40-56, August 2009. The two dipoles must be fed signals that are phase shifted by 90 degree electrical relative to each other. For narrowband antennas the phase shift may be obtained by detuning the two dipoles, one tuned to a higher frequency and the other tuned to a lower frequency. For broadband applications it is necessary to use a device such as a branch line coupler or a quadrature hybrid coupler. See Rao, K. S., J. Kopal, M. Q. Tang, and S. G. Gupta, "A High Performance Circularly Polarized Feed Array for Satellite Communication Antennas," IEEE APS Int. Sym. June 1989, Vol 3, pp. 1420-1423. Some have used printed circuit board techniques for building a "Crossed-Drooping Dipole Antenna" for circular polarization. See U.S. Pat. No. 4,686,536 to Allcock.

The turnstile and circular waveguide cavity circularly polarized antenna can be built to produce high purity right hand circularly polarized radiation in the upward direction. However, there is strong tendency for most RHCP antennas radiating upward to radiate LHCP in the downward direction. This is undesirable as the antenna can receive reflected signals from the ground. These signals would originally be RHCP but on reflection from the ground they will become LHCP which can enter the antenna from the backward direction. It is therefore desirable to build the antenna to suppress reception of LHCP signals coming from the backward or downward direction. A dipole placed above a circular ground plane with a diameter of about 0.5 to 1.0 wavelengths will give a front to back ratio of about 8 to 14 dB. See Tranquilla, J. M. and R G. Colpitts, "Development of a class of antenna for spacebased Naystar GPS applications", 6th Int. Conf. Ant. & Prop., ICAP 89, April 1989, Vol. I, pp. 65-69; Scire-Scappuzzo, F., and S. N. Makarov, "A Low-Multipath Wideband GPS Antenna with Cutoff or Non-Cutoff Corrugated Ground Plane", IEEE Trans. A&P, Vol. 57, No. 1, pp. 33-46, January 2009. For GNSS applications, a device known as a "choke ring" is widely used to isolate the basic RHCP antenna from LHCP signals coming from the direction of the ground. Choke rings are generally large with a diameter of 36 cm or more, with weights of a few Kg or more and are expensive, but they reduce the back LHCP radiation by about 10 to 15 dB.

Referring to FIG. 1, the antenna described in U.S. Patent Publication 20090204372 (which is hereby incorporated in its entirety by reference) uses two sets of dipoles with each set having two dipoles tuned to two frequencies. These dipoles may act like tuned circuits that are closely coupled to each other and may be regarded as coupled resonant circuits. Traditionally, it is known that over-coupled resonant circuits give a poor match and poor transmission of power at intermediate frequencies. See "Electronic and Radio Engineering," T. E. Terman, McGraw-Hill Inc. 1955, Fourth Edition, pp. 63-72, Sec. 3.5, entitled "Behavior of Systems Involving Resonant Primary and Secondary Circuits." FIG. 2 shows a basic antenna also found in the prior art having a circular waveguide cavity with the top end open and the bottom end closed, dual crossed dipoles, no back radiation suppression disk, and a mounting stem.

SUMMARY OF THE INVENTION

Antennas are presented. In some embodiments, the antenna may include a waveguide having an aperture at a first end and a conducting component at a second end, the conducting component shorting the waveguide. Also, in some embodiments, a first driven dipole may be substantially orthogonal to a second driven dipole, and both the first and second driven dipoles may be located near the aperture of the waveguide. In some embodiments, the first and second driven dipoles may be inside the waveguide. Furthermore, in some embodiments, the first and second driven dipoles may be connected to the conducting component by one or more plates and configured to be fed in quadrature. A resonator may be positioned near the first and second driven dipoles.

In some embodiments, the resonator may comprise a dual axis resonator coupled to the first driven dipole and the second driven dipole. Also, in some embodiments, the resonator may be a ring or disk, or may comprise a plurality of radially oriented conductors. The radially oriented conductors may be linear conductors. In some embodiments, the resonator further may comprise a plurality of circumferentially oriented conductors and radially oriented conductors. Furthermore, in some embodiments, the waveguide may have a vertical central axis and the second end may be partially tapered towards the vertical central axis.

In some embodiments, the antenna may include a waveguide having an aperture at a first end and a conducting component at a second end, the conducting component shorting the waveguide. Also, in some embodiments, the waveguide may be configured to reduce circumferential current flow.

In some embodiments, a first driven dipole may be positioned substantially orthogonal to a second driven dipole, and both dipoles may be located near the aperture of the waveguide. In some embodiments, both dipoles may be inside the waveguide. In some embodiments, the first and second driven dipoles may be coupled to the conducting component by one or more plates and configured to be fed in quadrature. Furthermore, in some embodiments, a resonator may be located near the first and second driven dipoles.

In some embodiments, the first end of the waveguide may comprise vertical slits, a saw tooth shape, and/or a grid of linear conductors. Also, in some embodiments, the waveguide may comprise a gap between the first end of the waveguide and the second end of the waveguide. In some embodiments, the first end of the waveguide may comprise substantially vertical conductors and a substantially circumferential ring conductor near the first end of the waveguide. The substantially vertical conductor may be parallel to the waveguide. Furthermore, in some embodiments, the wave guide may comprise discrete impedances configured to reduce circumferential current flow. In some embodiments, a top of the second end of the waveguide may be configured to reduce circumferential current flow. In some embodiments, the antenna may comprise a disk coupled to the second end of the waveguide that is substantially centered on the central axis of the waveguide.

The term "coupled" is defined as connected, although not necessarily directly, and not necessarily mechanically.

The terms "a" and "an" are defined as one or more unless this disclosure explicitly requires otherwise.

The term "substantially" and its variations are defined as being largely, but not necessarily wholly, what is specified as understood by one of ordinary skill in the art, and in one nonlimiting embodiment "substantially" refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. For example, an antenna may have a resonator, and in some cases, may also have vertical slits. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

Other features and associated advantages will become apparent with reference to the following detailed description of specific embodiments in connection with the accompanying drawings.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1:
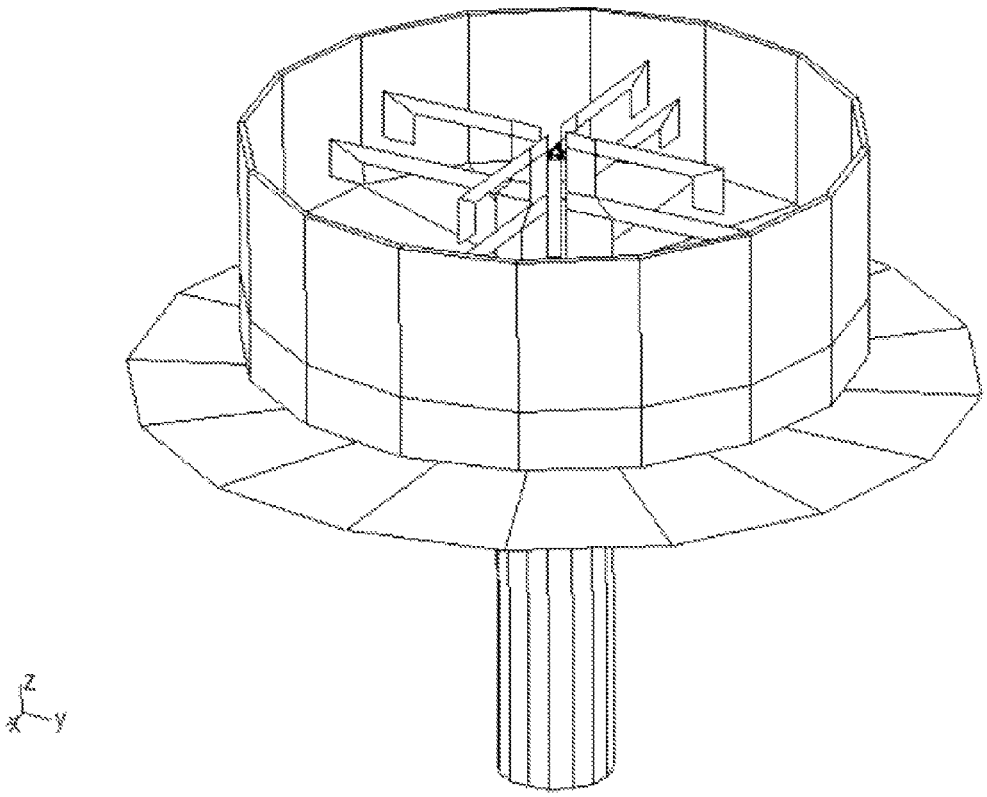
FIG. 1 (PRIOR ART)
FIG. 1 shows an antenna found in the prior art having a circular waveguide cavity with top end open and bottom end closed, dual crossed dipoles, a back radiation suppression disk, and a mounting stem.

Various features and advantageous details are explained more fully with reference to the nonlimiting embodiments that are illustrated in the accompanying drawings and detailed in the following description. Descriptions of well known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The improved antennas described herein may have better broadband impedance characteristics for improved delivery of received signal power to the quadrature hybrid and the GNSS receivers. The antennas may have reduced LHCP signal reception out of the RHCP output port for all angular directions of the arriving signal—upward, downward, and from the horizon. Similarly, the antennas may have reduced RHCP signal reception out of the LHCP output port for all angular directions of the arriving signal—upward, downward, and from the horizon. The phase center of the antennas may remain in one location with very small positional variations as the angular position of the incoming signal varies and as the frequency varies. In some embodiments, the antennas should be as compact as possible and should be easy to manufacture.

GNSS antennas may have two dipoles that may receive signals at two different frequencies. For example, in a GPS antenna, a first dipole may be configured to receive a signal having a frequency of about 1575 MHz (the L1 signal), and a second dipole may be configured to receive a signal having a frequency of about 1225 MHz (the L2 signal). In some embodiments of the disclosed antennas, improved broadbanding may be achieved by removing dipoles tuned to 1575 MHz and introducing a parasitic resonator or "passive coupled resonant" structure ("resonator") tuned to about 1575 MHz and located near driven dipoles, which may be tuned to about 1225 MHz. One advantage of a parasitic structure such as a resonator is that the coupling of the parasitic structure to the fed dipoles can be adjusted and optimized for best matching over required operating frequencies. In some embodiments, the new approach requires a single driven (or directly fed) dipole to be oriented in the x directional and a single driven (or directly fed) dipole to be oriented in the y direction. Each dipole may have two straps connecting the inner ends of the dipole elements going to the shorting disk at the bottom end of the circular waveguide cavity. The dipole feed lines may be integrated with these straps. Simple parasitic resonant structures may now be introduced near the two dipoles. The parasitic component may include radial elements, circumferential components, and/or combinations of continuous and discontinuous radial and circumferential elements. The elements may be conducting structures. In some embodiments, dielectric structures may also be used.

For circular polarization reception, the parasitic resonant broadbanding device may include two separate resonant orthogonally-positioned linear elements or a single dual-axes resonant element where the axes are orthogonal to each other. For the following discussion, the non-limiting embodiment of a dual axes resonant element will be used and it is to be noted that similar results may be obtained with two separate linear or quasi-linear resonant elements.

Figure 3:
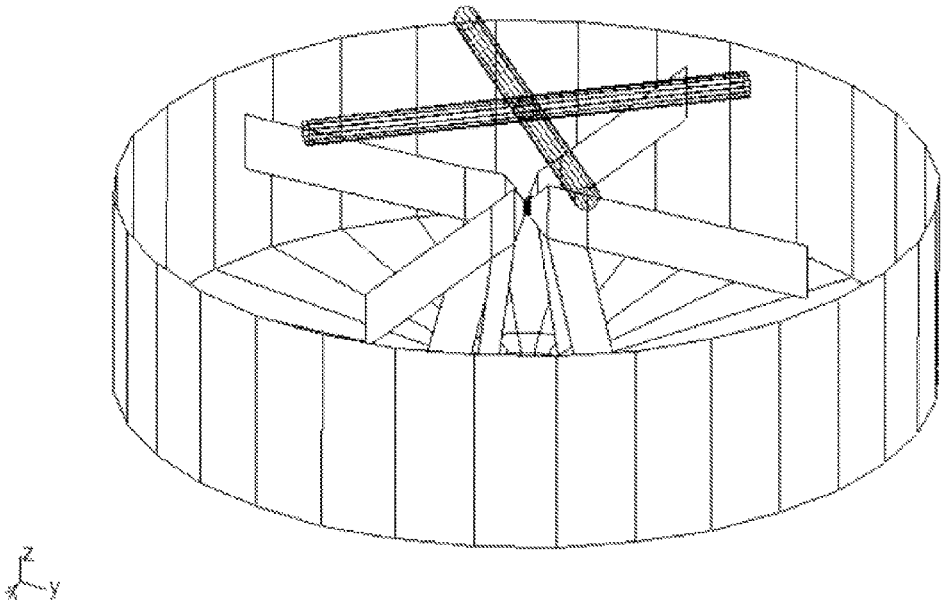
FIG. 3 shows an antenna having two crossed driven dipoles placed at the aperture of a circular waveguide cavity (or cup) with four radial conducting wires joined at the center.

Four radial conductors spaced substantially at 90 degrees apart, as shown in FIG. 3, and coupled at the center may make a parasitic two-axes resonant structure. The length and diameter of the radial elements and the spacing to the crossed dipoles can be adjusted to affect impedance match. In some embodiments, the number of radial conductors may be increased by any multiple of four, and the angular spacing of the conductors may vary. The conductors may be arranged to be symmetrical with respect to the crossed dipoles which here lie on the x and y axes and should repeat themselves when rotated by 90 degrees on the z axis. The elements are to be largely oriented in the radial direction but may include parts or partial sections that have components oriented in the circumferential direction, as discussed below.

Figure 4:
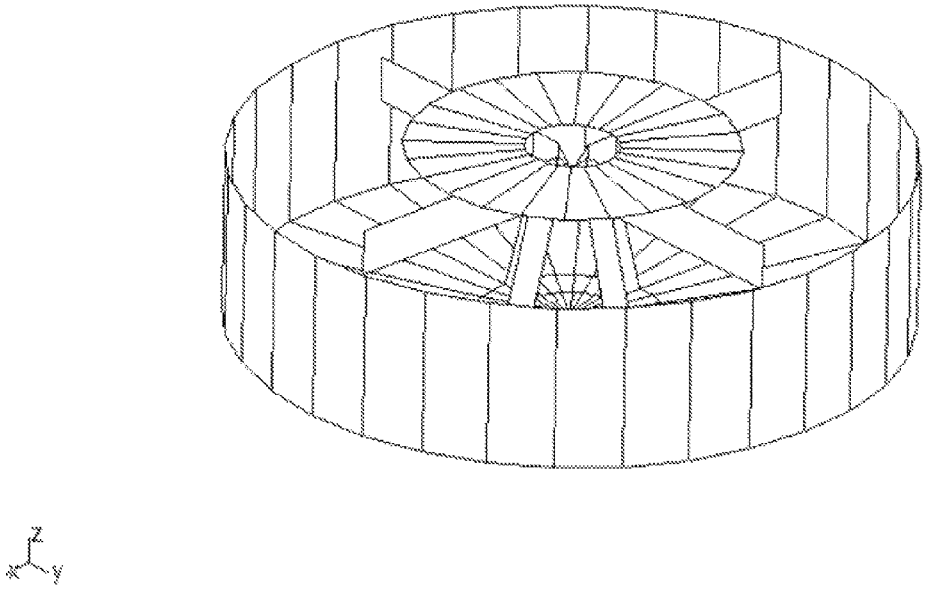
FIG. 4 shows an antenna having two crossed driven dipoles at the aperture of a circular waveguide cavity (or cup) with a circumferential ring.

A circumferential conducting ring, as shown in FIG. 4, may also serve as a parasitic two-axes resonant structure. The inner and outer radii of the ring and the spacing to the dipoles may be adjusted for a good match over the required ranges of frequencies. In some embodiments, the conducting ring may be made with discrete sides of different lengths but the segments of the ring must be symmetrical with respect to the crossed dipoles and the structure should repeat itself when it is rotated 90 degrees on the z axis. The main orientations of the segments are in the circumferential direction but they may include a component of orientation in the radial direction.

Figure 5:
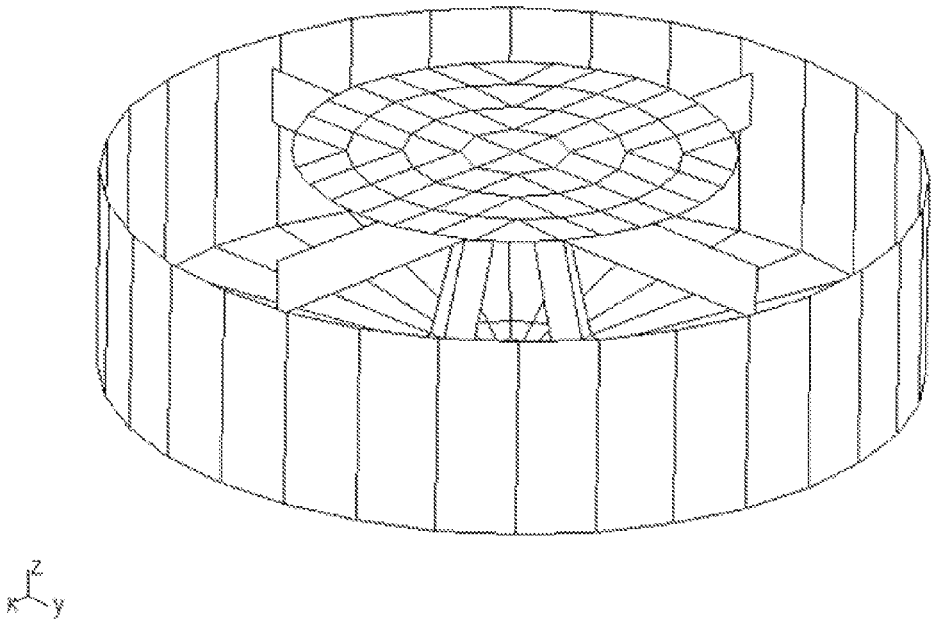
FIG. 5 shows an antenna having two crossed driven dipoles placed at the aperture of a circular waveguide cavity (or cup) with a conducting disk.

A conducting disk, as shown in FIG. 5, may also serve as a parasitic two-axes resonant structure. The radius of the disk and the spacing to the dipoles may be adjusted for a good match over the required ranges of frequencies. In some embodiments, the conducting disk may be made with discrete sides of different lengths but the sides of the disk must be symmetrical with respect to the crossed dipoles and the structure should repeat itself when it is rotated 90 degrees on the z axis. The main orientations of the sides are in the circumferential direction but they may include components of orientation in the radial direction.

Figure 6:
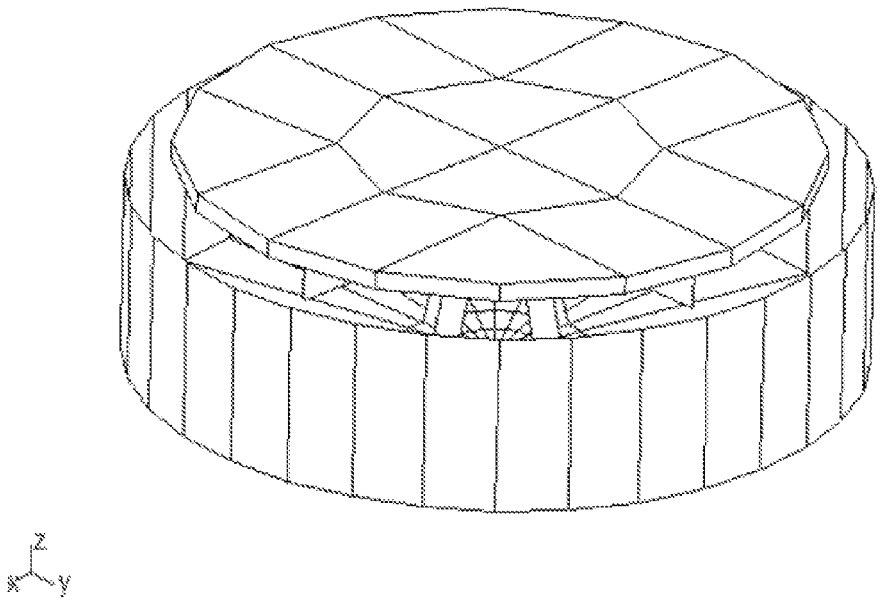
FIG. 6 shows an antenna having two crossed driven dipoles placed at the aperture of a circular waveguide cavity (or cup) with a thick dielectric disk.

A thick dielectric disk, as shown in FIG. 6, may serve as a parasitic two-axes resonant structure. The radius, thickness and dielectric constant of the disk and the spacing to the dipoles may be adjusted for a good match over the required ranges of frequencies. The conducting disk may be made with discrete sides of different lengths but the sides of the disk must be symmetrical with respect to the crossed dipoles and the structure should repeat itself when it is rotated 90 degrees on the z axis. The main orientations of the sides are in the circumferential direction but they may include components of orientation in the radial direction.

Figure 7:
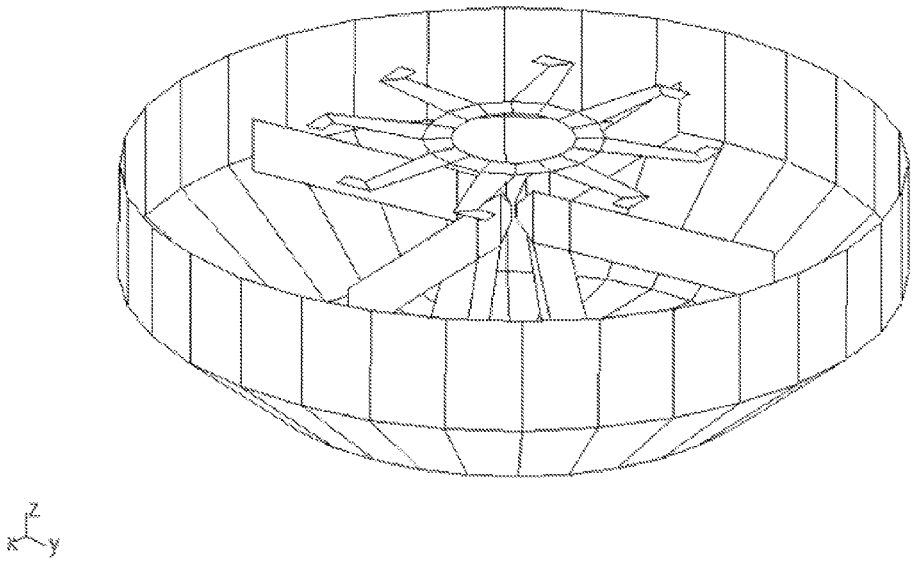
FIG. 7 shows an antenna having two crossed driven dipoles placed at the aperture of a circular waveguide cavity (or cup) with interconnected radial and circumferential conductors. The circular waveguide base has a reduced tapered radius.

A two-axes resonant structure may also have interconnected radial and circumferential elements, as shown in FIG. 7. In this embodiment, the structure must be symmetrical with respect to the crossed dipoles and must repeat itself when it is rotated by 90 degrees on the z axis. This latter structure may also enhance RHCP signals over LHCP signals. The various elements of the structure may be adjusted in size and spacing for low return loss over the desired GNSS frequencies. In some embodiments, the circular waveguide may be tapered towards the shorted end along a centerline. The tapered end may improve reception of RHCP signals over LHCP signals.

Figure 2:
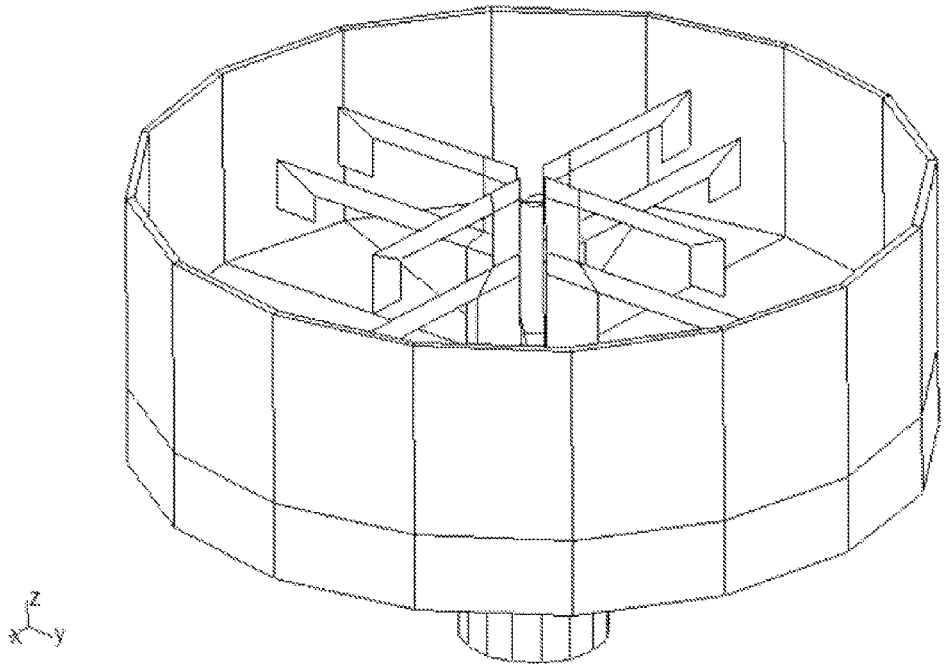
FIG. 2 (PRIOR ART)
FIG. 2 shows a basic antenna found in the prior art having a circular waveguide cavity with top end open and bottom end closed, dual crossed dipoles, no back radiation suppression disk, and a mounting stem.
Figure 8:
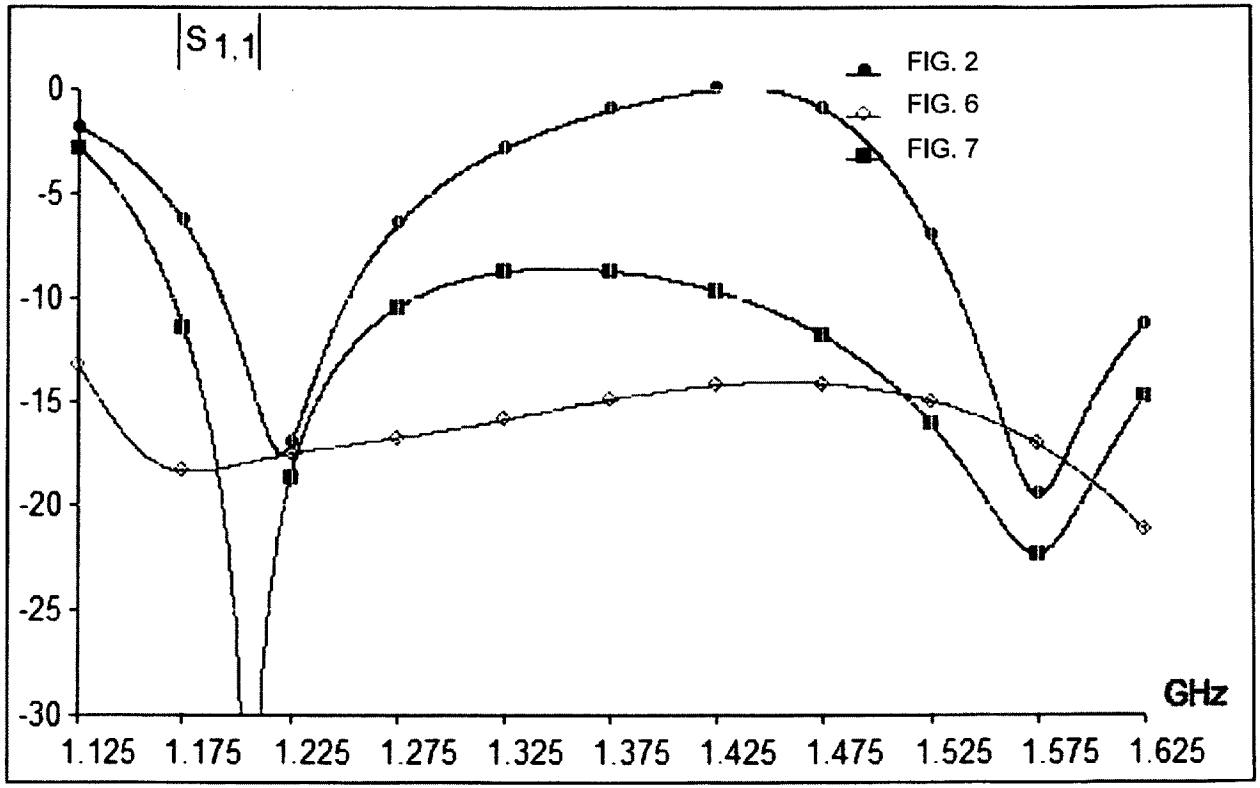
FIG. 8 shows a graph depicting return losses for the antennas shown in FIGS. 2, 6, and 7. All antennas have a quarter wave transmission line matching transformer to bring the input impedance to 50 Ohms. The parasitic structures of FIGS. 3, 4 and 5 give similar responses as the structure of FIG. 7.

FIG. 8 shows the results of mathematical modeling comparing of the return loss of the antenna depicted in FIG. 2 and the antennas depicted in FIGS. 6 and 7 that have parasitic structures. The described parasitic structures may provide a better impedance match over the required range of frequencies than the antenna of FIG. 1. The parasitic structures could be generalized by using more radial wires, fewer sides on the ring or the disks, but, in some cases, not less than four. The parasitic structure must repeat itself when rotated on the z axis by 90 degrees. The parasitic dual axes resonant structure may be replaced by two linear or largely linear structures.

Figure 9:
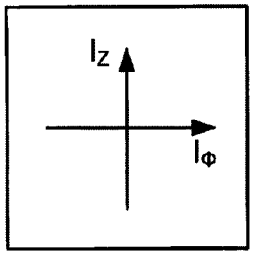
FIG. 9 shows a square conductor with electric currents which produce radiation having pure RHCP.

FIG. 9 shows that if a conducting structure is going to radiate a high purity RHCP wave into a space, the structure must have a current in one direction and another current at right angles with the same magnitude and a 90 degree phase shift. Deviation from this condition may lead to reduced purity of RHCP radiation.

Figure 10:
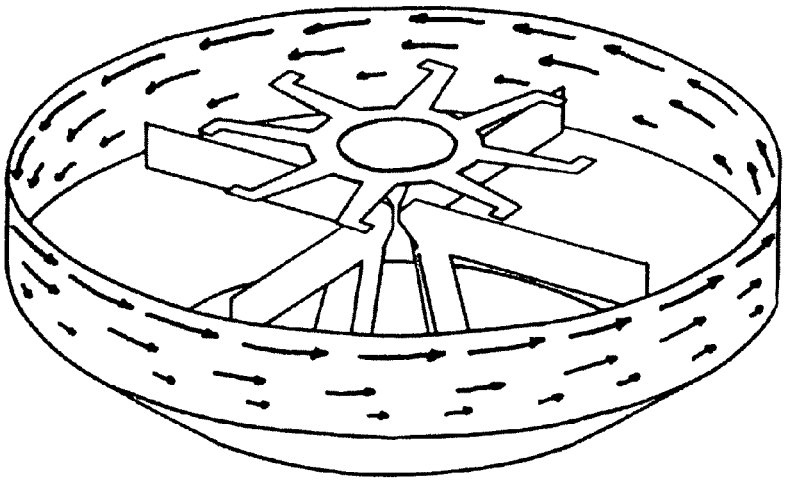
FIG. 10 shows circumferential current flows near the top of a waveguide wall. The vertical current flow is relatively small and is not shown.

WIPL-D has been used to show the magnitude of the currents in the various conducting structures of the antenna. FIG. 10 shows a circumferential current at the top of the waveguide wall. In this embodiment, there is not a corresponding strong z-directed current. One may not expect a strong z-directed current at the top of the circular waveguide wall as that current encounters an open circuit. The circumferential current may produce a largely linear horizontal polarization EM propagating wave, especially towards the horizon and also at directions above and below the horizon. The linear polarization can be regarded as a combination of RHCP and LHCP. The RHCP may combine with the RHCP emitted by the waveguide aperture but the LHCP may be undesired output radiation. It may be important to reduce the LHCP output. The current on the far wall of the waveguide has a reverse direction but due to the phase delay of the signal propagating across the top of the waveguide aperture the two radiation components may tend to constructively combine increasing the LHCP radiation even more.

Figure 11:
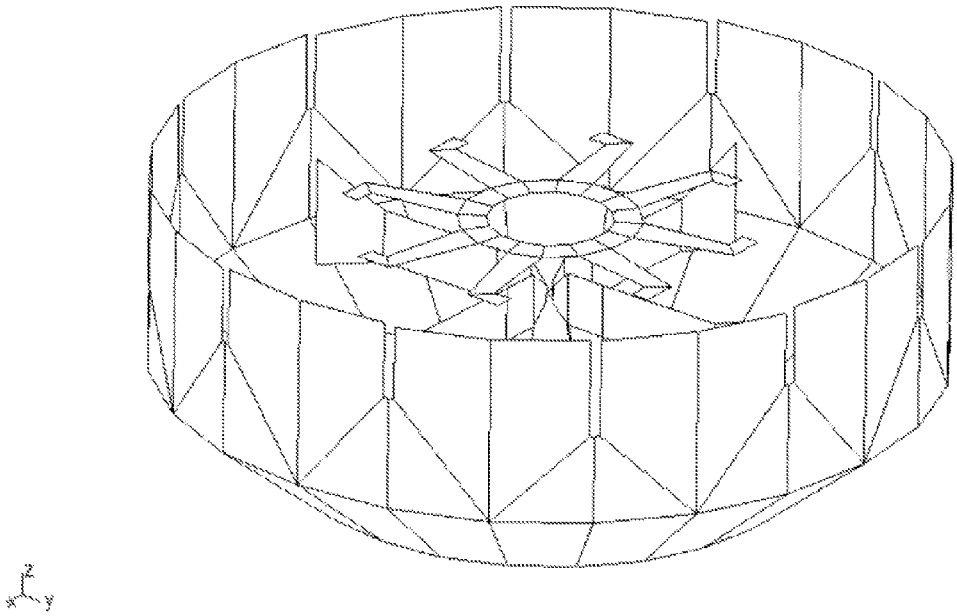
FIG. 11 shows an RHCP antenna with vertical cuts constructed in the top of the waveguide wall to reduce circumferential current flow in the waveguide wall and to reduce LHCP radiation.
Figure 12:
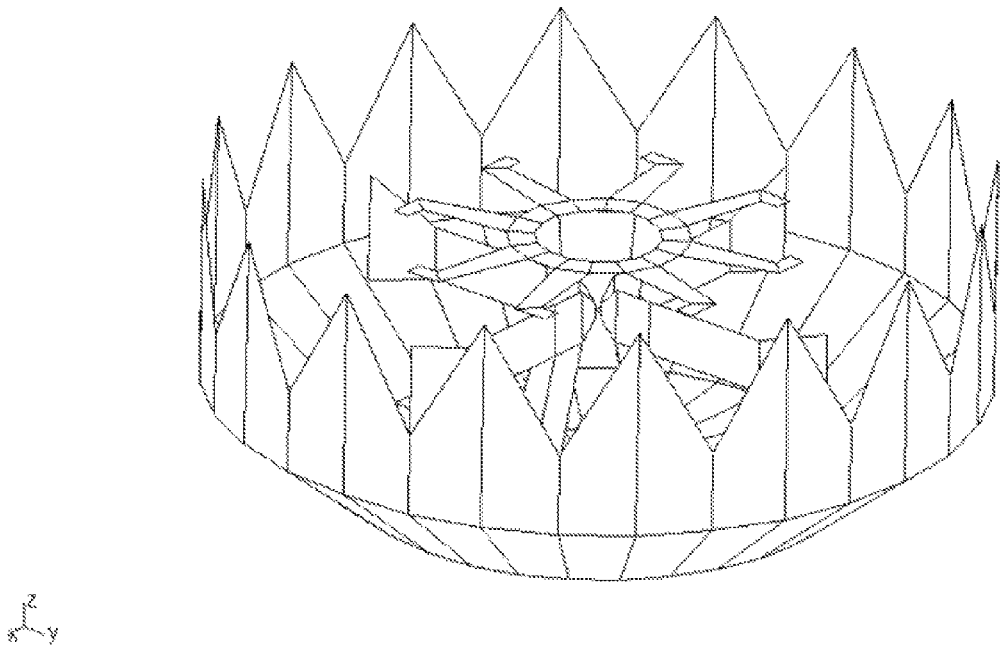
FIG. 12 shows an RHCP antenna with a uniform saw tooth shape constructed in the top of the waveguide wall to reduce circumferential current flow in the waveguide wall and to reduce LHCP radiation.
Figure 13:
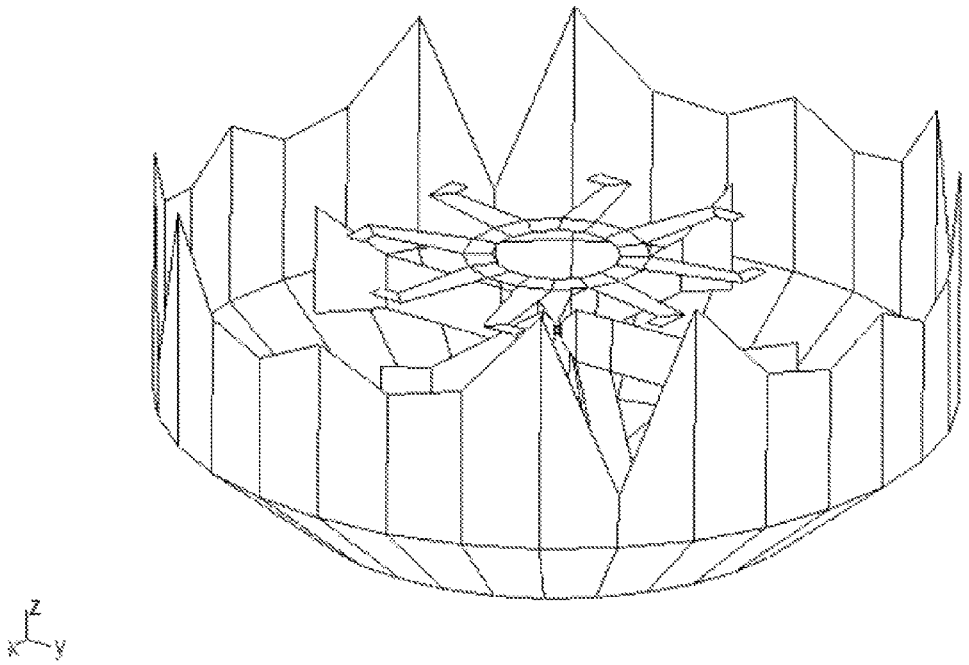
FIG. 13 shows an RHCP antenna with a non-uniform saw tooth shape constructed in the top of the waveguide wall to reduce circumferential current flow in the waveguide wall for reduced LHCP radiation.
Figure 14:
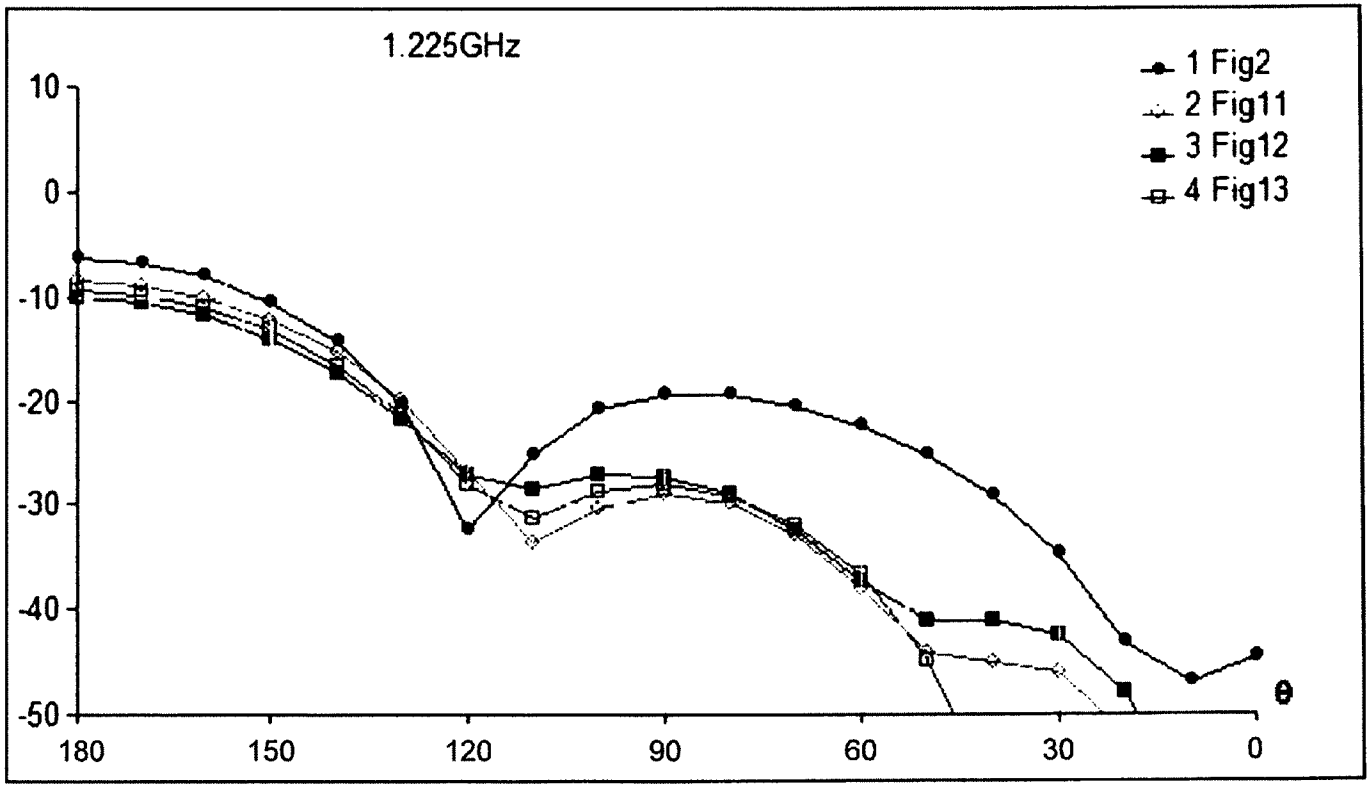
FIG. 14 shows LHCP radiation plots of the RHCP antennas shown in FIGS. 2, 11, 12, and 13 with the modified waveguide cavity aperture for the GNSS band L2 or 1225 MHz. The LHCP radiation of the prior art antenna of FIG. 2 is shown for comparison purposes.

One way of reducing the LHCP is by the reduction of the circumferential current near the top of the waveguide. This can be accomplished by cutting vertical slots into the circular waveguide walls, as shown in FIG. 11. Note that in this embodiment, the driven or fed dipoles have been shortened by broadening the outer ends. Another method of reducing the circumferential current is by making this current flow a longer path by building a saw tooth (i.e. serration), as shown in FIG. 12, in the top edge of the waveguide. The teeth of the toothed structure may have rectangular, triangular, or other shapes. The serration may be uniform or non-uniform, as shown in FIG. 13. The number of "teeth" or slots may range from about eight to about twenty-four. As the number becomes larger there may be a decreasing improvement in the performance. These structures may reduce the LHCP significantly, as shown in FIG. 14. FIG. 14 shows LHCP radiation plots of the RHCP antennas shown in FIGS. 2, 11, 12, and 13 with the modified waveguide cavity aperture for the GNSS band L2 or 1225 MHz. The LHCP radiation of the antenna of FIG. 2 is shown for comparison purposes. The best improvement in the LHCP reduction may occur for the lower frequency band for radiation above the horizon. The backward radiation directly downwards may be relatively large and a backward radiation suppression disk (or disks) may be used.

Figure 15:
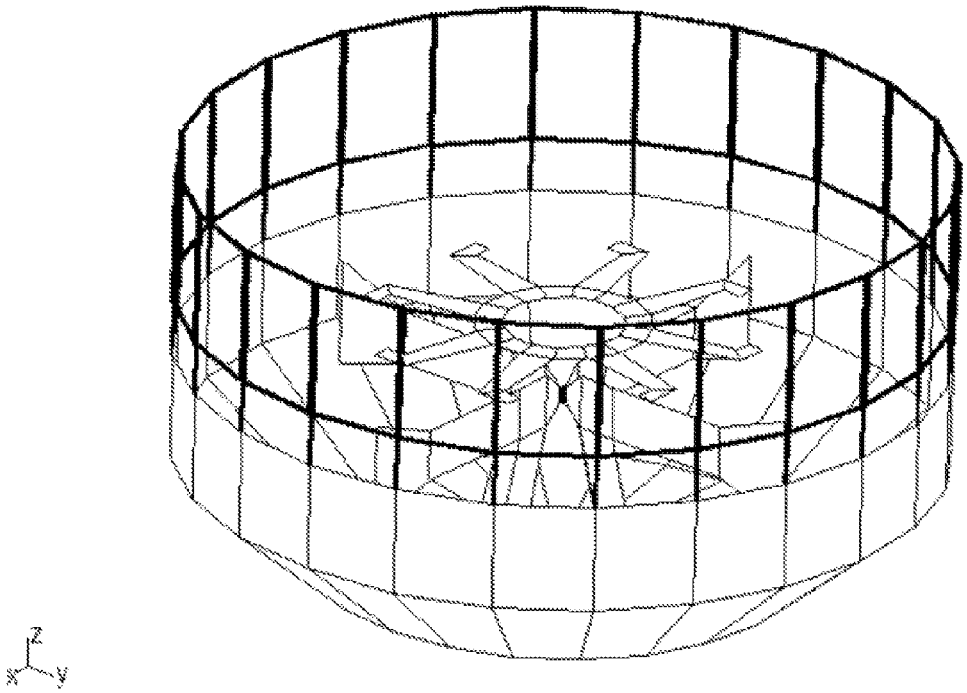
FIG. 15 shows an HPCP antenna with the waveguide formed by a rectangular wire grid.

Another approach to the construction of a structure to reduce the circumferential current and to control the z directed current is by the formation of the circular waveguide wall with a wire grid or grid of conducting strips directed in the circumferential and z directions, as shown in FIG. 15. This type of structure may allow the placement of discrete impedances (most likely pure reactances) to control the relative magnitudes and phase relationships of the circumferential and z directed currents. The conducting wires may also be directed at angles intermediate between the z and phi (circumferential) directions to produce a lattice type of wire or conducting strip grid. These structures may give a similar suppression of the LHCP as the structures shown in FIGS. 11, 12 and 13.

Figure 16:
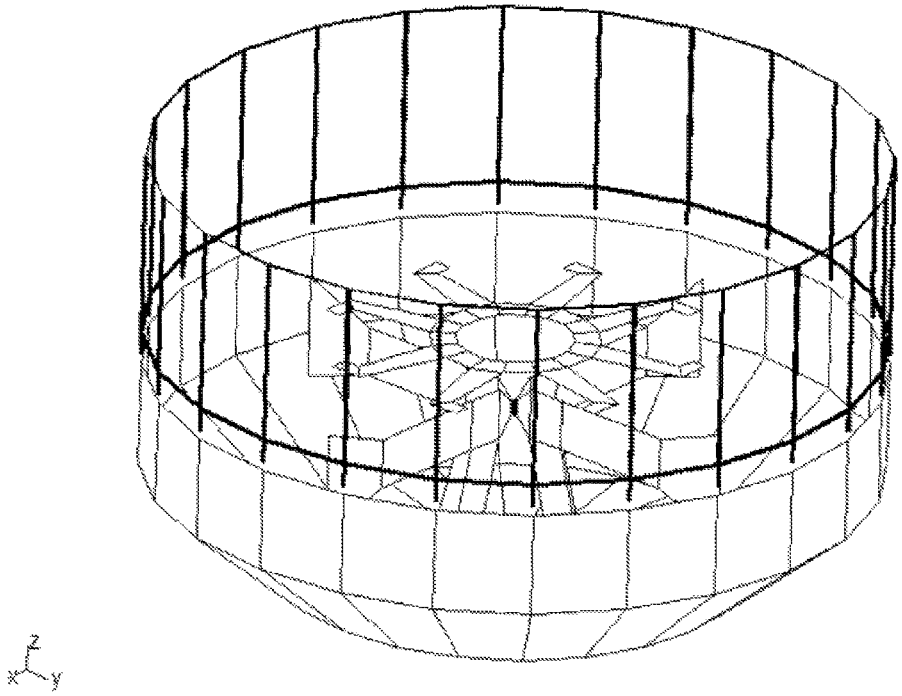
FIG. 16 shows an HPCP antenna with the waveguide formed by an interconnected rectangular wire grid with a gap between the grid and the lower continuous cylindrical conductor wall forming the circular waveguide.
Figure 17:
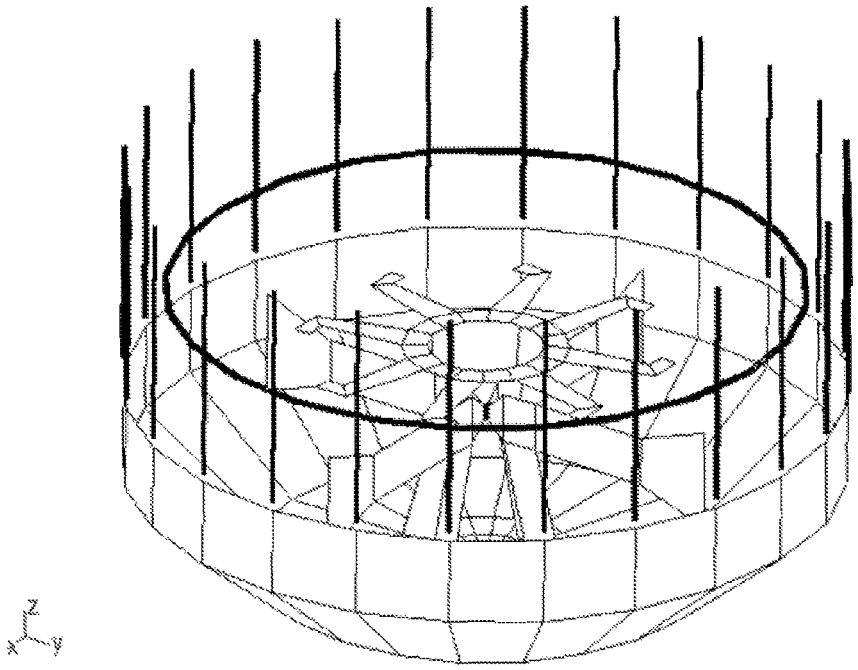
FIG. 17 shows an HPCP antenna with the top section of the waveguide formed by z directed wires and a circumferential wire. The wires are not connected to each other.
Figure 18:
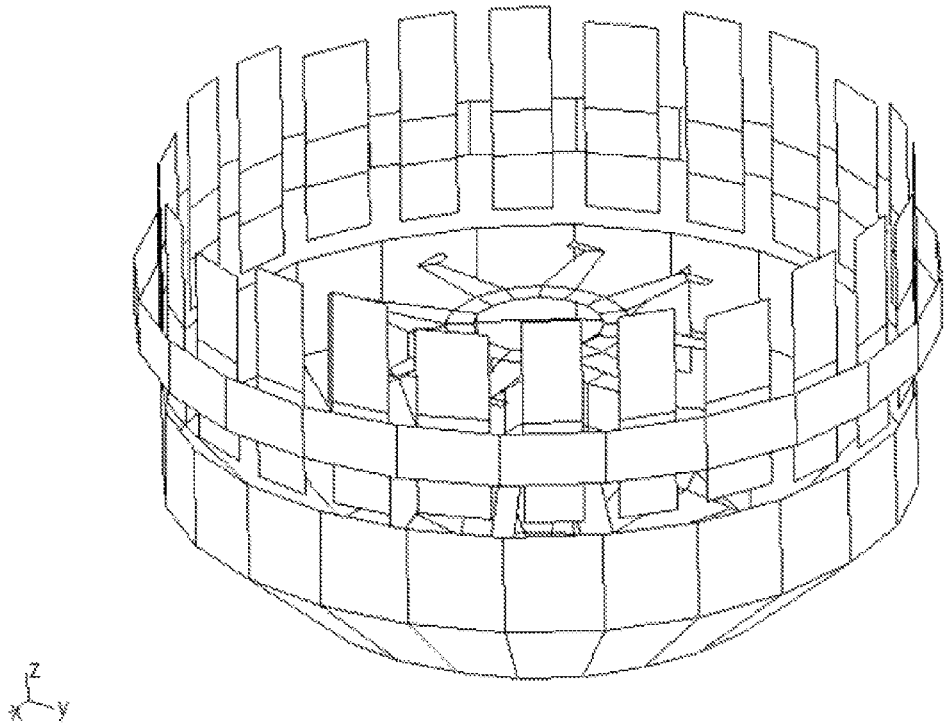
FIG. 18 shows an HPCP antenna with the waveguide formed by z directed conducting strips and a circumferential conducting strip. The conducting strips are not connected to each other.

As shown in FIG. 16, in some embodiments, the waveguide may comprise wire grid that is not electrically connected to the solid waveguide wall. Note the gaps between the lower ends of the vertical wires and the top of the continuous conductor circular waveguide wall. This structure may provide additional suppression of the LHCP signals, especially in the downward direction. The generalization of the structure may be extended by building numerous vertical elements and circumferential elements and the vertical and horizontal elements may be connected to each other or not be connected to each other. As shown in FIG. 17, the horizontal (or circumferential) element may be placed closer to the top of the waveguide. The vertical and horizontal elements may be built as wires or as conducting strips. The wire structure may be optimized by varying wire dimensions and positions for the best LHCP suppression. For example, as shown in FIG. 18, the waveguide may include vertical and horizontal strips. The number of vertical conducting strips or vertical wires may range from about eight to about twenty-four, as the number becomes larger there may be a decreasing improvement in the performance. Multiple continuous circumferential strip or wire conductors may be used. This type of structure may allow for the control of the circumferential currents and vertical currents independently of each other and this may allow the LHCP radiation to be minimized in all directions.

Figure 19:
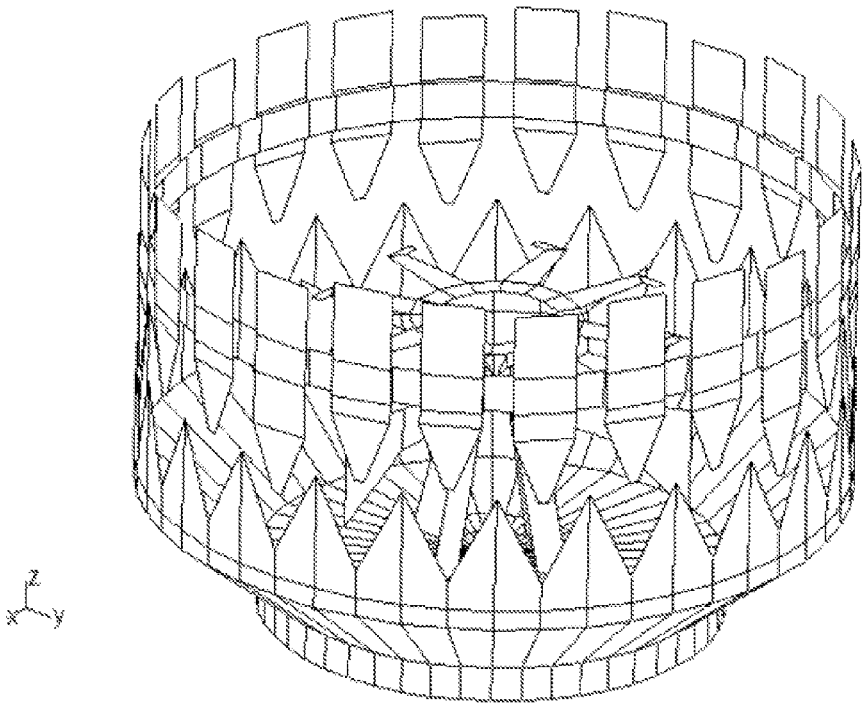
FIG. 19 shows an HPCP antenna with the waveguide formed by z directed conducting strips and a circumferential conducting strip. The top of the continuous waveguide wall is given a uniform saw tooth shape and the vertical conductors have a saw tooth shape to mesh with the lower waveguide section. The conducting strips are not connected to each other.

As shown in FIG. 19, serrations may be used in the continuous conductor waveguide wall with a matching spacing between the vertical conductors. The dimensions of the vertical strips or plates may be adjusted according to their position around the perimeter of the waveguide for improved suppression of LHCP radiation. Conducting strips may be constructed using printed circuit board fabrication technology. The antenna of FIG. 19 has an internal cavity where electronic components may be placed. It should be noted that an antenna may combine features described above.

The improved suppression of all signals in the downward direction of this antenna type may diminish the need for a back-radiation suppression disk. EM simulations on the antenna of FIG. 19 show that the front (upward RHCP) to back (downward LHCP) ratio ranges from about 40 dB to 30 dB over the frequency range of the antenna. Due to this improved performance a choke ring may not be required, resulting in a compact and light antenna.

Figure 20:
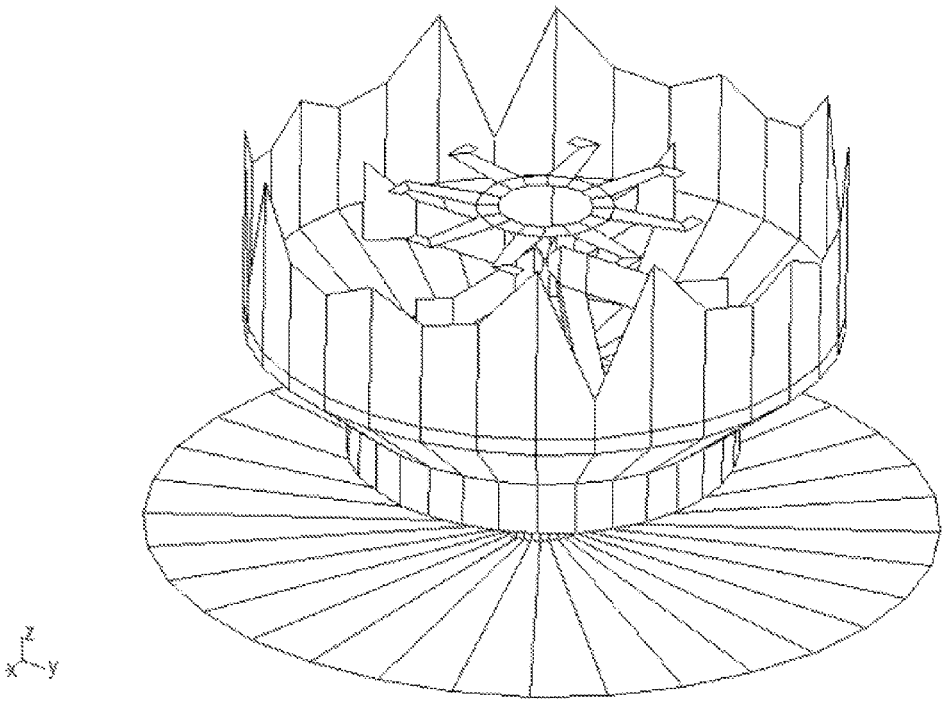
FIG. 20 shows an antenna having a non-uniform saw tooth shape and a back radiation suppression disk.
Figure 21:
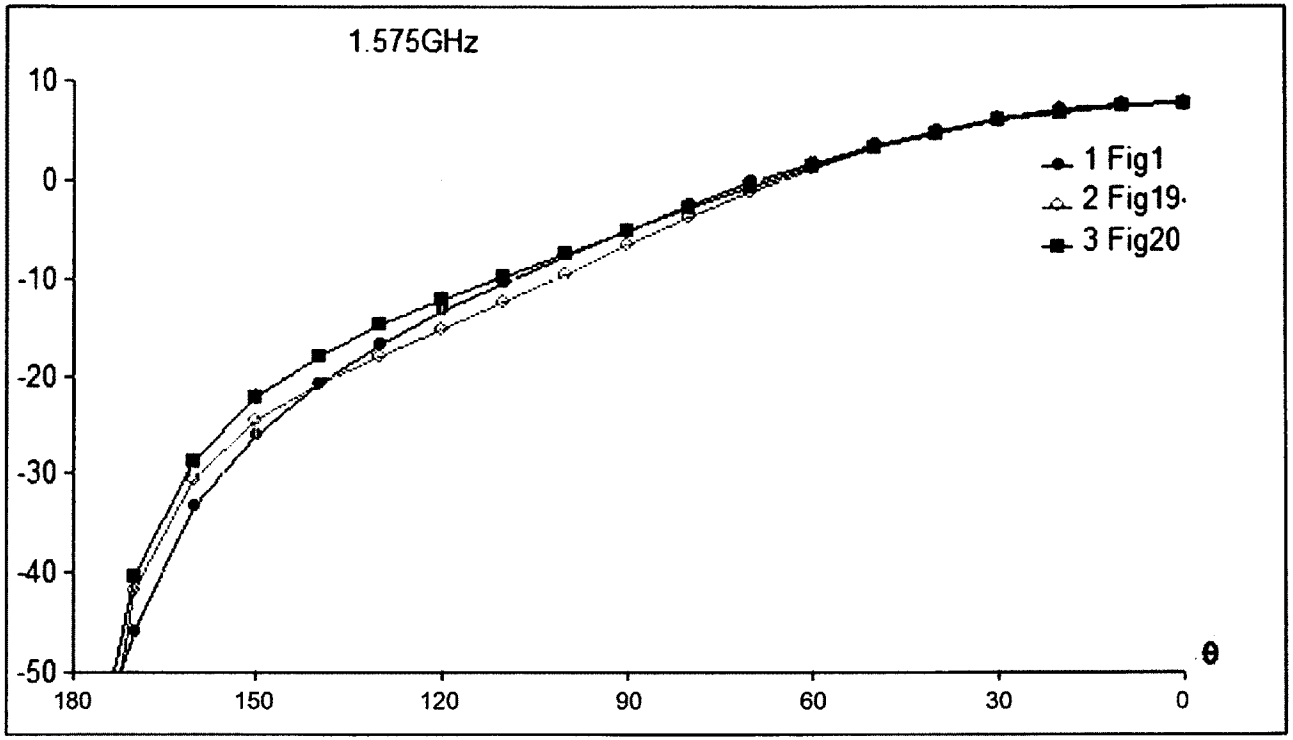
FIG. 21 shows a plot of RHCP radiation of the antennas of FIGS. 1, 19 and 20 for the L1 GNSS band (1575 MHz) as a function of vertical angle.
Figure 22:
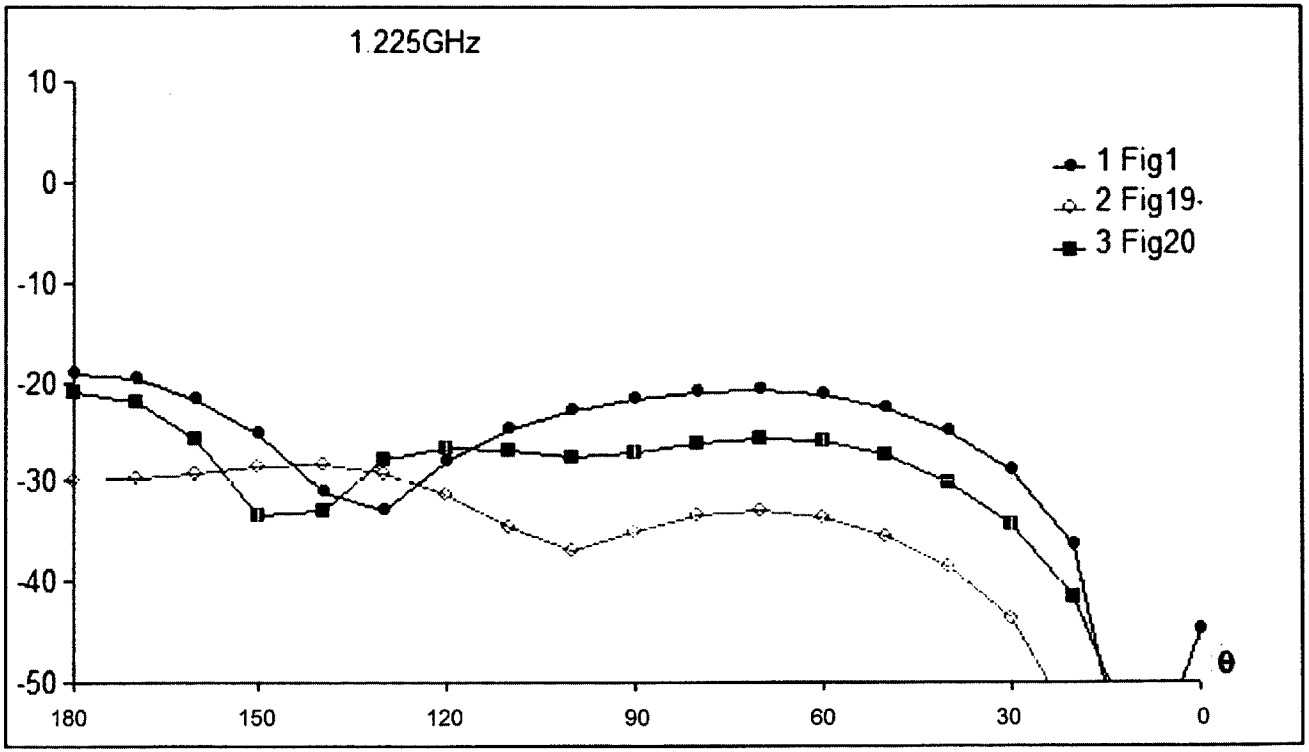
FIG. 22 shows a plot of LHCP radiation of the antennas of FIGS. 1, 19 and 20 for the L2 GNSS band (1225 MHz) as a function of vertical angle.
Figure 23:
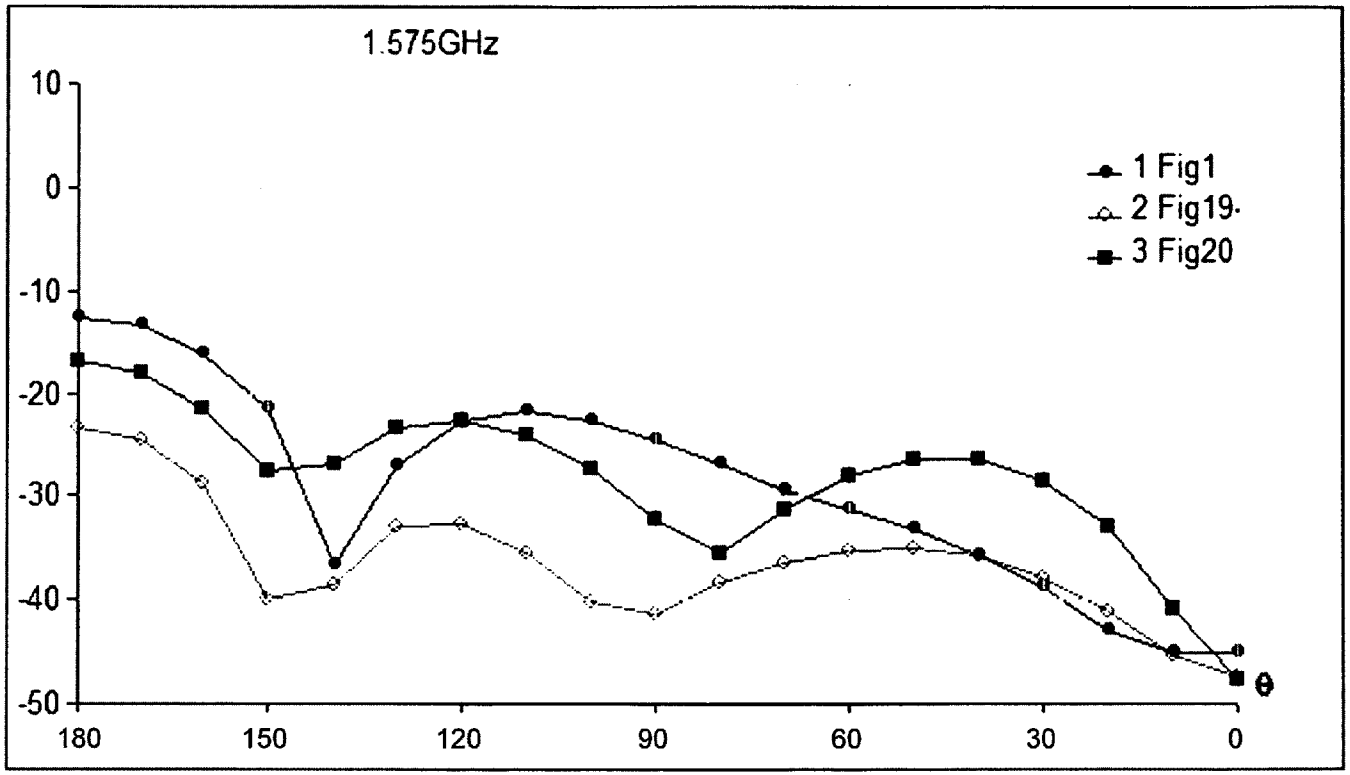
FIG. 23 shows a plot of LHCP radiation of the antennas of FIGS. 1,19 and 20 for the L1 GNSS band (1575 MHz) as a function of vertical angle.
Figure 24:
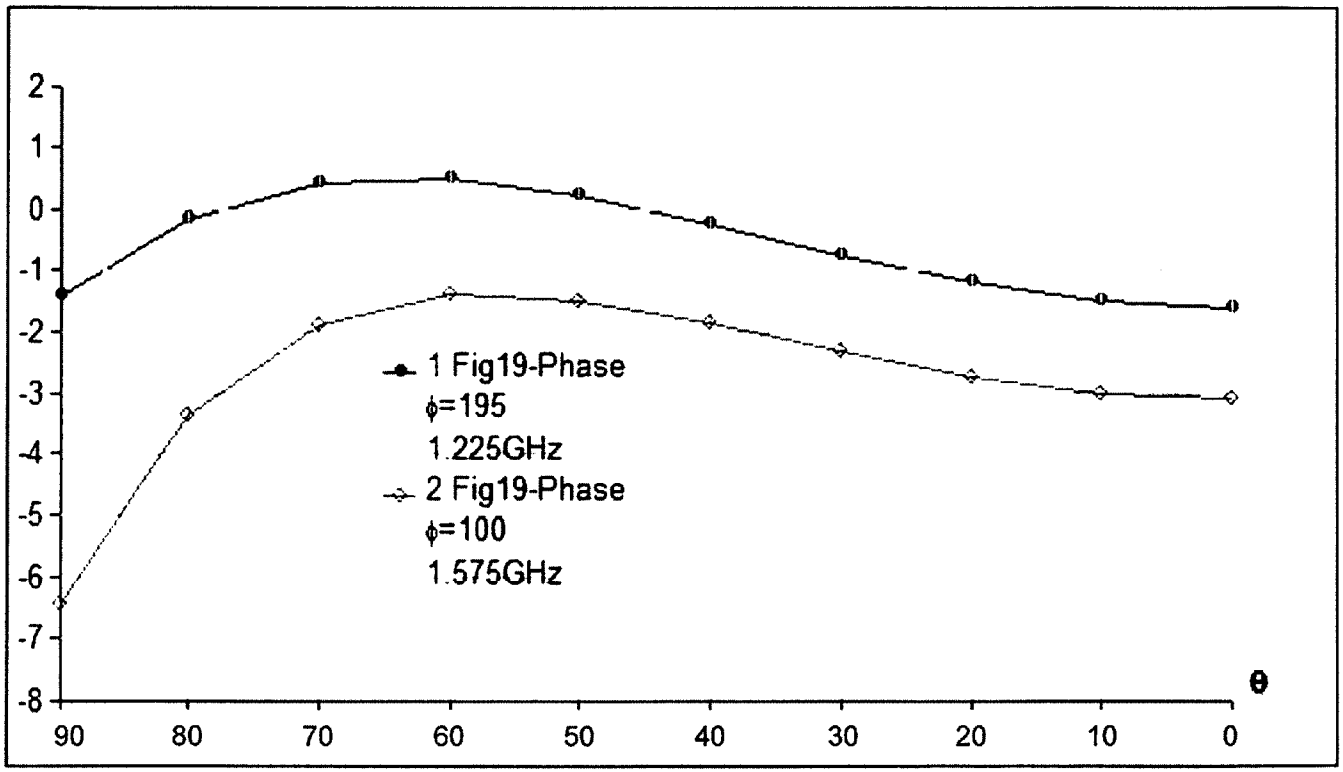
FIG. 24 shows a plot of RHCP radiation phase of the antenna of FIG. 19 for the L1 and L2 bands as a function of vertical angle.

As shown in FIG. 20, a backward radiation suppression disk may be used with an antenna having a continuous conductor circular waveguide wall and a non-uniform saw tooth shape. FIG. 21 compares RHCP radiation of the antennas of FIGS. 1, 19, and 20. FIG. 22 compares LHCP radiation of the antennas of FIGS. 1, 19, and 20 at 1225 MHz. FIG. 23 compares LHCP radiation of the antennas of FIGS. 1, 19 and 20 at 1575 MHz. FIG. 24 shows the phase of the RHCP radiation as a function of vertical angle above the horizon of antenna of FIG. 19.

The performance of these antennas has been shown for the frequencies of 1225 and 1575 MHz. The performance of the antennas at the frequencies of 1175, 1205 and 1275 MHz are very similar to the performance at 1225 MHz. The performance of the antennas at the frequencies of 1525 to 1625 are very similar to the performance at 1575 MHz.

In some uses, each dipole feeds a port of a hybrid coupler and this has two outputs each of which feeds a GNSS receiver. In some embodiments, the performance of the hybrid coupler or a branch line coupler is very important. If we have an ideal hybrid coupler, when one input port is fed a signal and the other input port is terminated in a matched load, there are two signals coming out of the output ports of equal amplitude and with a 90 degree phase shift between them. For the above antennas to operate as described above, the signal output amplitudes must be very similar. For example 0.1 to 0.2 dB may be a maximum difference and the phase difference may be very close to 90 degrees plus or minus 1 or 2 degrees maximum. In addition, the hybrid and the low noise amplifiers should each have a return loss of better than about 25 dB. The antenna should have a return loss of more than about 15 dB for all GNSS frequencies. Unbalanced signals reflecting back and forth from the amplifier and the antenna through the hybrid are likely to introduce unbalanced signal amplitudes and variations from the required 90 degree phase shifts. In short, the design and performance of the hybrid and low-noise amplifiers will also be important in the design and performance the GNSS antenna. This antenna may use any coupler or device that performs the same functions as the 3 dB quadrature hybrid coupler or 3 dB branch line coupler. Most couplers are built with a characteristic impedance of 50 Ohms. The antenna output port and amplifiers input port will need to be matched closely to 50 Ohms for best operation. In cases where the hybrid coupler does not function exactly as it should, adjustments may be made in the signal chain to compensate for non-ideal behavior of the hybrid.

These antennas may be operated as receiving and as transmitting antennas. The antennas may be low loss structures and therefore have high radiation efficiency. When the antennas are operated as receiving antennas with built in Low Noise Amplifiers, they may provide excellent carrier to noise ratios on signals received from GNSS satellites. These antennas have been optimized for good operation over a broadband with best performances at 1.225 and 1.575 GHz. Practical dimensions for the antenna of FIG. 19, including a radome, would be about 150 mm (6 inches) in diameter and about 150 mm in height (6 inches). This configuration may give a front to back ratio roughly equal to the best choke ring. If best operation is desired at one frequency, then the optimum construction may change and it is to be expected that an extremely good axial ratio would be approachable, on the order of 0.5 dB in the upper hemisphere.

What is claimed is:

1. An antenna comprising:

a waveguide having an aperture at a first end and a conducting component at a second end, the conducting component shorting the waveguide;

a first driven dipole substantially orthogonal to a second driven dipole, both the first and second driven dipoles located near the aperture of the waveguide, wherein the first and second driven dipoles are connected to the conducting component by one or more plates and configured to be fed in quadrature; and a resonator positioned near the first and second driven dipoles.

2. The antenna of claim 1, where the resonator comprises a dual axis resonator coupled to the first driven dipole and the second driven dipole.

3. The antenna of claim 1, where the resonator comprises a ring.

4. The antenna of claim 1, where the resonator comprises a disk.

5. The antenna of claim 1, where the resonator comprises a plurality of radially oriented conductors.

6. The antenna of claim 5, where the resonator further comprises a plurality of circumferentially oriented conductors and radially oriented conductors.

7. The antenna of claim 1, where the waveguide has a vertical central axis and the second end is partially tapered towards the vertical central axis.

8. An antenna comprising:

a waveguide having an aperture at a first end and a conducting component at a second end, the conducting component shorting the waveguide, the waveguide configured to reduce circumferential current flow; and a first driven dipole substantially orthogonal to a second driven dipole, both dipoles located near the aperture of the waveguide, wherein the first and second driven dipoles are coupled to the conducting component by one or more plates and configured to be fed in quadrature.

9. The antenna of claim 8, further comprising a resonator located near the first and second driven dipoles.

10. The antenna of claim 8, where the first end of the waveguide comprises vertical slits.

11. The antenna of claim 8, where the first end of the waveguide comprises a saw tooth shape.

12. The antenna of claim 8, where the first end of the waveguide comprises a grid of linear conductors.

13. The antenna of claim 8, where the waveguide comprises a gap between the first end of the waveguide and the second end of the waveguide.

14. The antenna of claim 8, where the first end of the waveguide comprises substantially vertical conductors and a substantially circumferential ring conductor near the first end of the waveguide.

15. The antenna of claim 8, where a top of the second end of the waveguide is configured to reduce circumferential current flow.

16. The antenna of claim 13, where a top of the second end of the waveguide is configured to reduce circumferential current flow.

17. The antenna of claim 14, where a top of the second end of the waveguide is configured to reduce circumferential current flow.

* * * * *